US006159678A

United States Patent [19]

Parton et al.

[11] Patent Number: 6,159,678

[45] Date of Patent: Dec. 12, 2000

[54] PHOTOGRAPHIC ELEMENT COMPRISING A MIXTURE OF SENSITIZING DYES

[75] Inventors: Richard L. Parton, Webster; Thomas R. Dobles, Hilton; David A. Stegman, Churchville, all of N.Y.; Teresa A. Smith, Belmont, Mass.; John D. Lewis, Webster, N.Y.

[73] Assignee: Eastman Kodak Company, Rochester, N.Y.

[21] Appl. No.: 09/151,132

[22] Filed: Sep. 10, 1998

Related U.S. Application Data

[60] Provisional application No. 60/058,796, Sep. 15, 1997.

[51] Int. Cl.[7] ..... G03C 1/16; G03C 1/29

[52] U.S. Cl. ..... 430/574; 430/572; 430/583

[58] Field of Search ..... 430/572, 574, 430/583

[56] References Cited

U.S. PATENT DOCUMENTS

| | | |
|---|---|---|
| 3,672,898 | 6/1972 | Schwan et al. . |
| 3,985,563 | 10/1976 | Hinata et al. . |
| 3,986,878 | 10/1976 | Hinata et al. . |
| 3,988,155 | 10/1976 | Hinata et al. . |
| 4,232,118 | 11/1980 | Okauchi et al. . |
| 4,439,520 | 3/1984 | Kofron et al. . |
| 4,469,785 | 9/1984 | Tanaka et al. . |
| 4,518,689 | 5/1985 | Noguchi et al. . |
| 4,925,780 | 5/1990 | Yoshizawa et al. . |
| 4,939,078 | 7/1990 | Kuramoto et al. . |
| 5,013,642 | 5/1991 | Muenter et al. . |
| 5,047,311 | 9/1991 | Endo et al. . |
| 5,049,485 | 9/1991 | Deaton . |
| 5,368,996 | 11/1994 | Asami . |
| 5,418,126 | 5/1995 | Stegman et al. . |
| 5,418,127 | 5/1995 | Budz et al. . |
| 5,474,887 | 12/1995 | Reed et al. . |
| 5,538,836 | 7/1996 | Ueda et al. . |
| 5,582,960 | 12/1996 | Nielsen et al. . |

FOREIGN PATENT DOCUMENTS

| | | |
|---|---|---|
| 683 427 | 11/1995 | European Pat. Off. . |
| 866 364 | 9/1998 | European Pat. Off. . |

OTHER PUBLICATIONS

Research Disclosure No. 36216, Jun. 1994, No. 362, Emsworth, GB.

*The Theory of the Photographic Process,* T.H. James, ed., 4th edition, Macmillan, New York 1977.

Y. Yonezawa, T. Miyama, and H Ishizawa, *J. Imaging Sci. Technol.,* 39 331 (1995);.

V. Bliznyuk and H. Mohwald, *Thin Solid Films,* 261 275 (1995);.

.L. Penner and D. Mobius, *Thin Solid Films,* 132 185 (1985).

G. Scheibe, A. Mareis, H. Ecker, *Naturwiss,* 29 474(1937).

*Primary Examiner*—Thorl Chea

*Attorney, Agent, or Firm*—Edith A. Rice

[57] ABSTRACT

A photographic element comprising at least one silver halide emulsion layer in which the silver halide has been sensitized with a first blue sensitizing dye having a $\lambda_1$ less than or equal to about 475 nm and a second blue sensitizing dye having a $\lambda_2$, wherein $\lambda_1$ is longer than $\lambda_2$ and $\lambda_1$ and $\lambda_2$ are separated by an energy gap, $\Delta E$, which does not exceed 0.12 eV, where $\Delta E$ is defined by the following relationship:

$$\Delta E = 1.25\frac{(\text{nm})}{(\text{eV})} \times 10^3\left(\frac{1}{\lambda 2(\text{nm})} - \frac{1}{\lambda 1(\text{nm})}\right) \leq 12.0\ (\text{eV})$$

wherein $\lambda_1$ is the wavelength in nanometers (nm) of maximum absorption of a silver halide emulsion sensitized with the first dye and $\lambda_2$ is the wavelength of maximum absorption of a silver halide emulsion sensitized with the second dye, with the proviso that neither the first nor the second dye contains selenium.

15 Claims, No Drawings

PHOTOGRAPHIC ELEMENT COMPRISING A MIXTURE OF SENSITIZING DYES

CROSS REFERENCE TO RELATED APPLICATION

Reference is made to and priority claimed from U.S. Provisional Application Ser. No. 60/058,796, filed Sep. 15, 1997, entitled PHOTOGRAPHIC ELEMENT COMPRISING A MIXTURE OF SENSITIZING DYES.

FIELD OF THE INVENTION

This invention relates to a photographic element, in particular to a photographic element comprising a silver halide emulsion layer containing at least two sensitizing dyes.

BACKGROUND OF THE INVENTION

It is well-known in the practice of spectral sensitization of silver halide emulsions for color photographic use that cyanine dyes used for this purpose typically J-aggregate upon adsorption to the silver halide crystal. (This is not to assert that J-aggregation is typical of cyanine dyes—only that it is a characteristic property of such cyanine dyes as are useful for photographic purposes.) A discussion of J-aggregation can be found in T. H. James, editor, *The Theory of the Photographic Process,* 4th Edition, Macmillan, N.Y., 1977. The discovery of two cyanine dyes which will, when applied to the emulsion simultaneously, form a so-called "mixed aggregate" has been a topic of great interest in the study of photographic science. See, for example, Y.Yonezawa, T. Miyama, and H Ishizawa, *J. Imaging Sci. Technol.,* 39 331(1995); V. Bliznyuk and H. Mohwald, *Thin Solid Films,* 261 275 (1995); T. L. Penner and D. Mobius, *Thin Solid Films,* 132 185 (1985) and G. Scheibe, A. Mareis, H. Ecker, *Naturwiss,* 29 474(1937).

The phenomenon has much to offer in the practice of photographic science. For example, the practice of spectral sensitization would no longer be constrained by the position of single dyes; rather, mixtures of dyes could be used to manipulate the location of spectral sensitization with impunity. This would provide great value to photography, as often the light output of the image or scene to be photographed is not in harmony with the light-capturing location of the presently available sensitizing dyes. However, the literature reports only isolated examples of dyes which have been found to form a mixed aggregate, and the physical rules which govern this behavior are only qualitatively known, as is evidenced by the following statement from Bliznyuk and Mohwald: "However, little is known about the molecular properties that determine miscibility or immiscibility. This is unfortunate, because mixed aggregates are very promising for various reasons." The extent of the qualitative understanding is simply that dyes must be sufficiently similar sterically to be compatible in the mixed aggregate, and that their individual aggregates may not be too distant from one another energetically. For example, Yonezawa et al. state that "it is plausible" that "nearly equal" positions of the two individual aggregate positions "favor the formation of the HA aggregate" (HA is defined as "homogeneous aggregate").

PROBLEM TO BE SOLVED BY THE INVENTION

These vague guidelines discussed above are not useful to photographic scientists and engineers who seek to deliberately design and construct dyes which will form the so-called mixed aggregates, and further to place them at specific locations in the visible spectrum. The vagueness leaves no alternative but the trial-and-error technique exemplified by Edison a century ago, which may never allow the desired goal to be attained.

SUMMARY OF THE INVENTION

We have discovered the energy boundary which governs the formation of mixed aggregates, and applied it to a series of cyanine dyes. With empirical structural constraints which we have further discovered, the formation of deliberately designed and constructed mixed aggregates of cyanine dyes is now possible.

One aspect of this invention comprises a photographic element comprising at least one silver halide emulsion layer in which the silver halide has been sensitized with a first blue sensitizing dye having a $\lambda_1$ less than or equal to about 475 nm and a second blue sensitizing dye having a $\lambda_2$, wherein wherein $\lambda_1$ is longer than $\lambda_2$ and $\lambda_1$ and $\lambda_2$ are separated by an energy gap, ΔE, which does not exceed 0.12 eV, where ΔE is defined by the following equation:

$$\Delta E = 1.25\frac{(\text{nm})}{(\text{eV})} \times 10^3\left(\frac{1}{\lambda 2(\text{nm})} - \frac{1}{\lambda 1(\text{nm})}\right) \leq 12.0\ (\text{eV})$$

wherein $\lambda_1$ is the wavelength in nanometers (nm) of maximum absorption of a silver halide emulsion sensitized with the long dye and $\lambda_2$ is the wavelength of maximum absorption of a silver halide emulsion sensitized with the short dye, with the proviso that neither the first nor the second dye contains selenium.

The photographic element may contain one or more additional blue sensitizing dyes.

ADVANTAGEOUS EFFECT OF THE INVENTION

This invention: provides an adjustable sensitization envelope by the appropriate selection of first and second dyes. Also, we have found much less speed loss when the first dye provides a maximum sensitization of 475 nm or less and the structural features of the dyes result in formation of a mixed aggregate.

DETAILED DESCRIPTION OF THE INVENTION

In our invention cyanine dyes which sensitize silver halide to blue light are used. Preferred dyes are of the following classes:

TABLE A

The General Series of Blue Chromophores Under Consideration

| Dye Structure | Peak Wavelength (nm) | Dye Class |
|---|---|---|
| 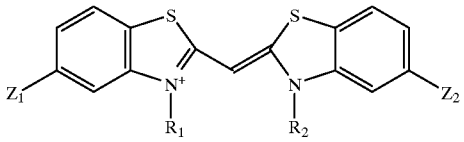 | 470 nm | Class F |
| 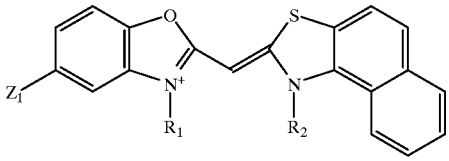 | 450 nm | ClassE |
| 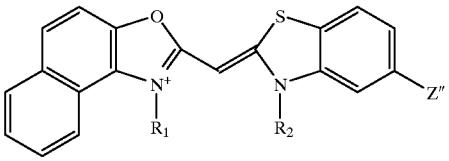 | 450 nm | Class E' |
| 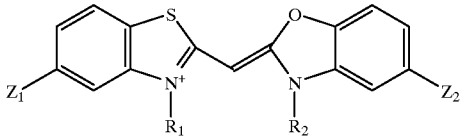 | 440 nm | Class D |
| 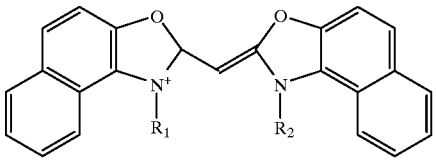 | 430 nm | Class C |
| 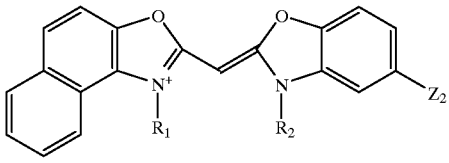 | 420 nm | Class B |
| 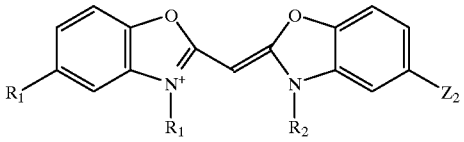 | 410 nm | Class A |

wherein $Z_1$, $Z_2$ and Z" are independently a hydrogen or halogen atom or a substituted or unsubstituted alkyl, substituted or unsubstituted alkoxy, substituted or unsubstituted aromatic, substituted or unsubstituted alkoxycarbonyl or substituted or unsubstituted heterocyclic group; and $R_1$ and $R_2$, are independently substituted or unsubstituted alkyl, substituted or unsubstituted alkenyl or substituted or unsubstituted aryl. In preferred embodiments of the invention, at least one of $R_1$ and $R_2$, contains a water solubilizing group, such as sulfoalkyl, carboxyalkyl, sulfoaryl and the like. The dyes may also contain one or more substituents in other positions of the benzo ring.

The approximate peak wavelength for each of the parent chromophores, when optimally substituted to enable aggregation, is shown. In general, we designate the pair of dyes which comprise the mixed aggregate as comprising a "long dye" and a "short dye" (i.e. dyes corresponding to the first and second dyes, respectively). Proceeding from top to bottom of Table A, adjacent pairs of long and short dyes will, when optimally substituted, form mixed aggregates. That is, a dye with a maximum peak wavelength of about 470 nm will form a mixed aggregate with a dye with a maximum peak wavelength of about 450 nm or greater, a dye with a maximum peak wavelength of about 450 nm will form a mixed aggregate with a dye with a peak wavelength of about 440 nm or greater, and so on down to a dye with a maximum peak wavelength of about 420 nm will form a mixed aggregate with a dye with a maximum peak wavelength of about 410 nm or greater. In the blue region of the spectrum the differences in wavelengths between the short and long dyes determined by a ΔE that does not exceed 0.12 eV will range from about 15 nm to about 25 nm. Dyes need not be of different classes. For example, it has been found that a dye at the high end of the wavelength range for dyes of that class can be advantageously used with a dye at the low end of the wavelength range. For example a dye of class F having a peak wavelength of about 470 nm can be paired with a dye of class F having a peak wavelength of about 465 nm or less (not exceeding 0.12 eV.)

The following Table A' provides a correlation between of the peak he long dye and the peak absorption wavelength of the peak absorption wavelength between the two dyes does not exceed 0.12 eV.

TABLE A'

| Long dye wavelength in nm | Short dye wavelength in nm |
|---|---|
| 400 | 385.2 |
| 401 | 386.1 |
| 402 | 387.1 |
| 403 | 388.0 |
| 404 | 388.9 |
| 405 | 389.8 |
| 406 | 390.8 |
| 407 | 391.7 |
| 408 | 392.6 |
| 409 | 393.5 |
| 410 | 394.5 |
| 411 | 395.4 |
| 412 | 396.3 |
| 413 | 397.2 |
| 414 | 398.2 |
| 415 | 399.1 |
| 416 | 400.0 |
| 417 | 400.9 |
| 418 | 401.9 |
| 419 | 402.8 |
| 420 | 403.7 |
| 421 | 404.6 |
| 422 | 405.6 |
| 423 | 406.5 |
| 424 | 407.4 |
| 425 | 408.3 |
| 426 | 409.3 |
| 427 | 410.2 |
| 428 | 411.1 |
| 429 | 412.0 |
| 430 | 413.0 |
| 431 | 413.9 |
| 432 | 414.8 |
| 433 | 415.7 |
| 434 | 416.6 |
| 435 | 417.6 |
| 436 | 418.5 |
| 437 | 419.4 |
| 438 | 420.3 |
| 439 | 421.2 |
| 440 | 422.2 |
| 441 | 423.1 |
| 442 | 424.0 |
| 443 | 424.9 |
| 444 | 425.8 |
| 445 | 426.8 |
| 446 | 427.7 |
| 447 | 428.6 |
| 448 | 429.5 |

TABLE A'-continued

| Long dye wavelength in nm | Short dye wavelength in nm |
|---|---|
| 449 | 430.4 |
| 450 | 431.4 |
| 451 | 432.3 |
| 452 | 433.2 |
| 453 | 434.1 |
| 454 | 435.0 |
| 455 | 436.0 |
| 456 | 436.9 |
| 457 | 437.8 |
| 458 | 438.7 |
| 459 | 439.6 |
| 460 | 440.5 |
| 461 | 441.5 |
| 462 | 442.4 |
| 463 | 443.3 |
| 464 | 444.2 |
| 465 | 445.1 |
| 466 | 446.0 |
| 467 | 447.0 |
| 468 | 447.9 |
| 469 | 448.8 |
| 470 | 449.7 |
| 471 | 450.6 |
| 472 | 451.5 |
| 473 | 452.5 |
| 474 | 453.4 |
| 475 | 454.3 |
| 476 | 455.2 |
| 477 | 456.1 |
| 478 | 457.0 |
| 479 | 457.9 |
| 480 | 458.9 |
| 481 | 459.8 |
| 482 | 460.7 |
| 483 | 461.6 |
| 484 | 462.5 |
| 485 | 463.4 |
| 486 | 464.3 |
| 487 | 465.2 |
| 488 | 466.2 |
| 489 | 467.1 |
| 490 | 468.0 |
| 491 | 468.9 |
| 492 | 469.8 |
| 493 | 470.7 |
| 494 | 471.6 |
| 495 | 472.5 |
| 496 | 473.5 |
| 497 | 474.4 |
| 498 | 475.3 |
| 499 | 476.2 |
| 500 | 477.1 |

As mentioned above, the dyes should be J-aggregating dyes which form a mixed aggregate when used in combination. As is well-known in the art, a very wide variety of substituents may be used to effect J-aggregation on predominantly AgBr emulsions. When the dye is an oxacyanine, thiacyanine, oxacarbocyanine, or thiacarbocyanine, there are abundant literature examples of aggregating cyanine dyes which contain lower akyl, halo, lower alkoxy, aromatic and heterocyclic substituents.

When reference in this application is made to a particular moiety as a "group", this means that the moiety may itself be unsubstituted or substituted with one or more substituents. For example, "alkyl group" refers to a substituted or unsubstituted alkyl, alkoxy refers to a substituted or unsubstituted alkoxy group, "aromatic substituent" refers to a substituted or unsubstituted aromatic group and "heterocyclic substituent" refers to a substituted or unsubstituted heterocyclic group. Generally, unless otherwise specifically stated, substituent groups usable on molecules herein include any groups, whether substituted or unsubstituted, which do not destroy properties necessary for the photographic utility. Examples of substituents on any of the mentioned groups can include known substituents, such as: halogen, for example, chloro, fluoro, bromo, iodo; alkoxy, particularly those "lower alkyl" (that is, with 1 to 6 carbon atoms, for example, methoxy, ethoxy; substituted or unsubstituted alkyl, particularly lower alkyl (for example, methyl, trifluoromethyl); thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); acid or acid salt groups such as any of those described below; and others known in the art. Alkyl substituents may specifically include "lower alkyl" (that is, having 1–6 carbon atoms), for example, methyl, ethyl, and the like. Further, with regard to any alkyl group or alkylene group, it will be understood that these can be branched or unbranched and include ring structures.

In embodiments of the invention in which the emulsion to be used is predominantly AgCl, the invention can be achieved with dyes that: (a) for the two dyes with one allowed 5-position substituent, it must be aromatic in character; and (b) for the dyes with two allowed 5-position substituents, at least one of them must be aromatic in character.

Examples of inventive and comparative dyes are shown in the following Table B. Note that the adjective "comparative" applies for these dyes only in reference to the AgCl emulsion; these dyes fail to aggregate or sustain the invention on this substrate. The predominant feature of this invention is that it applies to pairs of dyes rather than to single dyes.

TABLE B

Illustrative Inventive and Comparative Dyes*

| Chromophore Class | Inventive (I) or Comparative (C) | 5-position substituent | 5'-position substituent | Dye Identifier |
|---|---|---|---|---|
| F | I | chloro | phenyl | F1 |
| | I | chloro | 1-pyrrolyl | F2 |
| | I (AgBr) or C (AgCl) | chloro | chloro | F3 |
| | I | phenyl | phenyl | F4 |
| | I | phenylcarbamoyl | phenyl | F5 |
| | I | phenylcarboxamido | phenyl | F6 |
| | I | phenyl | $CO_2Me$ | F7 |
| | I' | fluorophenyl-carboxamido | chloro | F8 |
| | C (AgCl) | 1-pyrrolyl | $CF_3$ | F9 |
| | C (AgCl) | phenyl | $CF_3$ | F10 |
| E | I | phenyl | n.a.** | E1 |
| | I | 2-thienyl | n.a. | E2 |
| | I | 1-pyrrolyl | n.a. | E3 |
| | I | 2-furyl | n.a. | E6 |
| | I (AgBr) or C (AgCl) | chloro | n.a. | E4 |
| | I (AgBr) or C (AgCl) | methoxy | n.a. | E5 |
| | I | n.a. | 1-pyrrolyl | E'1 |
| | I | n.a. | phenyl | E'2 |
| D | I | chloro | phenyl | D1 |
| C | I | n.a. | n.a. | C1 |
| B | I | n.a. | phenyl | B1 |
| A | I | phenyl | phenyl | A1 |

*$R_1$ and $R_2$ each represent 3-sulfopropyl unless otherwise indicated.
**n.a. stands for not applicable-the 5-position of the benzo ring is not available for substitution.

This invention describes the use of the combination of at least two blue sensitizing dyes having specifically different structures in combination with a silver halide emulsion so as to adjust the sensitization maximum of the element. This can afford improved color reproduction while maintaining high photographic sensitivity.

Preferred combinations of dyes include, for example:

A. the first dye is of the structure:

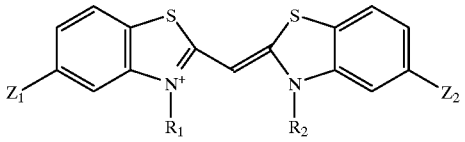

and the second dye is of the structure:

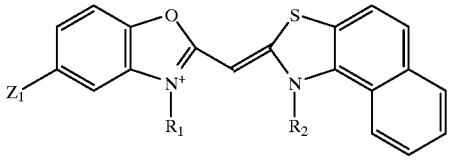

B. the first dye is of the structure:

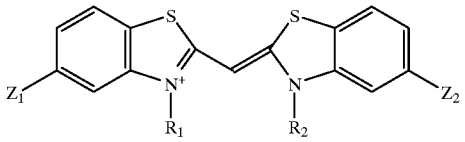

and the second dye is of the structure:

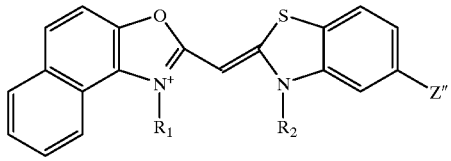

C. the first dye is of the structure:

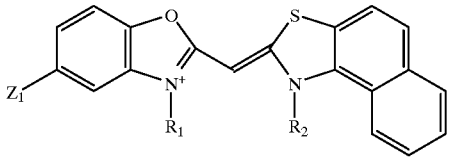

and the second dye is of the structure:

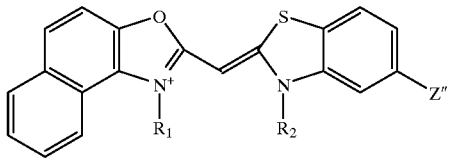

D. the first dye is of the structure:

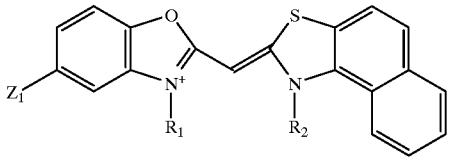

and the second dye is of the structure:

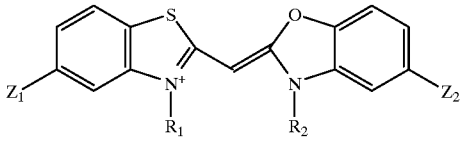

-continued

E. the first dye is of the structure:

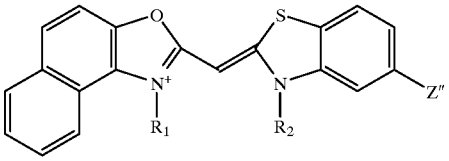

and the second dye is of the structure:

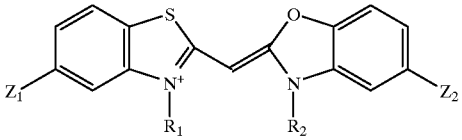

F. the first dye is of the structure:

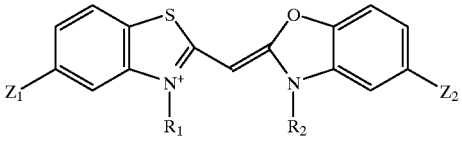

and the second dye is of the structure:

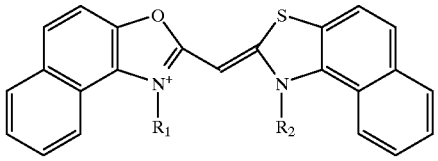

G. the first dye is of the structure:

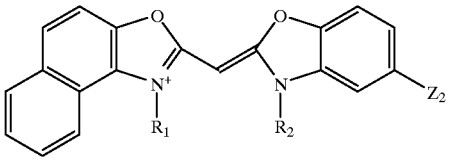

and the second dye is of the structure:

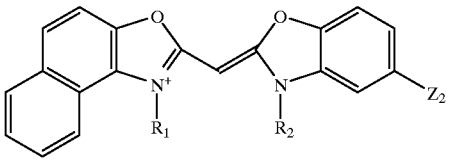

H. the first dye is of the structure:

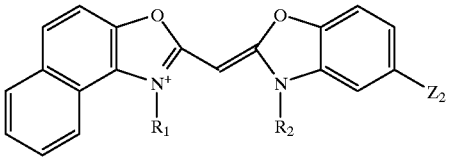

and the second dye is of the structure:

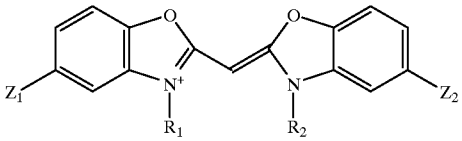

wherein $Z_1$, $Z_2$ and Z" are independently a hydrogen or halogen atom or a substituted or unsubstituted alkyl, substituted or unsubstituted alkoxy, substituted or unsubstituted aromatic, substituted or unsubstituted alkoxycarbonyl and substituted or unsubstituted heterocyclic group; and $R_1$ and $R_2$, are independently substituted or unsubstituted alkyl, substituted or unsubstituted alkenyl or substituted or unsubstituted aryl.

Particularly preferred blue dyes for use in this invention are of structures I and II defined below.

Dye I

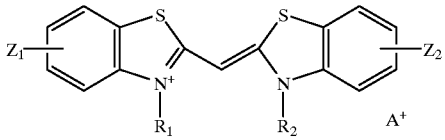

wherein:

$Z_1$ is phenyl, pyrrolyl, furanyl, thienyl, alkoxycarbonyl or a fused benzene ring;

$Z_2$ is phenyl, pyrrolyl, furanyl, thienyl, alkoxycarbonyl or halogen, $R_1$ and $R_2$ are acid substituted alkyl groups; and $A^+$ is a counterion, Dye II

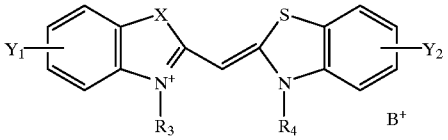

wherein

X is O or S, $Y_1$ is pyrrolyl, furanyl, thienyl, alkoxycarbonyl or phenyl;

$Y_2$ is a 4,5-benzo substituent when X is O and a phenylcarbamoyl or a phenylcarboxamido substituent when X is S;

$R_3$ and $R_4$ are acid substituted alkyl groups; and $B^+$ is a counterion.

In the above formulae, $A^+$ and $B^+$ are counterions required to balance the net charge of the dye. Any positively charged counterion can be utilized. Common counterions that can be used include sodium, potassium, triethylammonium ($TEA^+$), tetramethylguanidinium ($TMG^+$), diisopropylammonium ($DIPA^+$), and tetrabutylammonium ($TBA^+$).

These dyes used in accordance with this invention can be synthesized by those skilled in the art according to the procedures described herein or in F. M. Hamer, *The Cyanine Dyes and Related Compounds* (Interscience Publishers, New York, 1964).

Illustrative preferred dyes are given in Table C

TABLE C

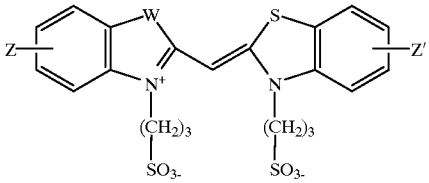

| Dye ID | Z | Z' | W |
|---|---|---|---|
| F2 | 5-Cl | 5-(1-Pyrrolyl) | S |
| F3 | 5-Cl | 5-Cl | S |
| F4 | 5-Ph | 5-Ph | S |

TABLE C-continued

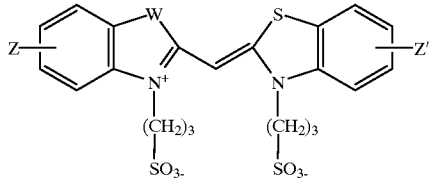

| Dye ID | Z | Z' | W |
|---|---|---|---|
| D1 | 5-Ph | 5-Cl | O |
| E4 | 5-Cl | 4,5-Benzo | O |
| E1 | 5-Ph | 4,5-Benzo | O |
| E2 | 5-(2-Thienyl) | 4,5-Benzo | O |
| F1 | 5-Phenyl | 5-Cl | S |
| E6 | 5-(2-Furanyl | 4,5-Benzo | O |
| E3 | 5-(1-Pyrrolyl) | 4,5-Benzo | O |
| F5 | 5-Phenycarbamoyl | 5-Ph | S |
| F6 | 5-Phenylcarboxamido | 5-Ph | S |
| F7 | 5-Ph | 5-$CO_2$Me | S |

The emulsion layer of the photographic element of the invention can comprise any one or more of the light sensitive layers of the photographic element. The photographic elements made in accordance with the present invention can be black and white elements, single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support).

Photographic elements of the present invention may also usefully include a magnetic recording material as described in *Research Disclosure,* Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to *Research Disclosure,* September 1996, Number 389, Item 38957, which will be identified hereafter by the term "Research Disclosure I." The Sections hereafter referred to are Sections of the Research Disclosure I unless otherwise indicated. All Research Disclosures referenced are published by Kenneth Mason Publications, Ltd., Dudley Annex, 12a North Street, Emsworth, Hampshire P010 7DQ, ENGLAND. The foregoing references and all other references cited in this application, are incorporated herein by reference.

The silver halide emulsions employed in the photographic elements of the present invention may be negative-working, such as surface-sensitive emulsions or unfogged internal latent image forming emulsions, or positive working emulsions of the internal latent image forming type (that are fogged during processing). Suitable emulsions and their preparation as well as methods of chemical and spectral sensitization are described in Sections I through V. Color materials and development modifiers are described in Sections V through XX. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); development inhibitors and their precursors (U.S. Pat. No. 5,460,932; U.S. Pat. No. 5,478,711); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located)

either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated wherein by reference.

It is also contemplated that the concepts of the present invention may be employed to obtain reflection color prints as described in *Research Disclosure,* November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540,653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds which may be useful in the elements of the invention are disclosed in Japanese Published Applications 83-09,959; 83-62,586; 90-072,629; 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide used in the photographic elements may be silver iodobromide, silver bromide, silver chloride, silver chlorobromide, silver chloroiodobromide, and the like.

The type of silver halide grains preferably include polymorphic, cubic, and octahedral. The grain size of the silver halide may have any distribution known to be useful in photographic compositions, and may be either polydispersed or monodispersed.

Tabular grain silver halide emulsions may also be used. Tabular grains are those with two parallel major faces each clearly larger than any remaining grain face and tabular grain emulsions are those in which the tabular grains account for at least 30 percent, more typically at least 50 percent, preferably >70 percent and optimally >90 percent of total grain projected area. The tabular grains can account for substantially all (>97 percent) of total grain projected area. The tabular grain emulsions can be high aspect ratio tabular grain emulsions—i.e., ECD/t>8, where ECD is the diameter of a circle having an area equal to grain projected area and t is tabular grain thickness; intermediate aspect ratio tabular grain emulsions—i.e., ECD/t=5 to 8; or low aspect ratio tabular grain emulsions—i.e., ECD/t=2 to 5. The emulsions typically exhibit high tabularity (T), where T (i.e., $ECD/t^2$) >25 and ECD and t are both measured in micrometers ($\mu$m). The tabular grains can be of any thickness compatible with achieving an aim average aspect ratio and/or average tabularity of the tabular grain emulsion. Preferably the tabular grains satisfying projected area requirements are those having thicknesses of <0.3 $\mu$m, thin (<0.2 $\mu$m) tabular grains being specifically preferred and ultrathin (<0.07 $\mu$m) tabular grains being contemplated for maximum tabular grain performance enhancements. When the native blue absorption of iodohalide tabular grains is relied upon for blue speed, thicker tabular grains, typically up to 0.5 $\mu$m in thickness, are contemplated.

High iodide tabular grain emulsions are illustrated by House U.S. Pat. No. 4,490,458, Maskasky U.S. Pat. No. 4,459,353 and Yagi et al EPO 0 410 410.

Tabular grains formed of silver halide(s) that form a face centered cubic (rock salt type) crystal lattice structure can have either {100} or {111} major faces. Emulsions containing {111} major face tabular grains, including those with controlled grain dispersities, halide distributions, twin plane spacing, edge structures and grain dislocations as well as adsorbed {111} grain face stabilizers, are illustrated in those references cited in *Research Disclosure I,* Section I.B.(3) (page 503).

The silver halide grains to be used in the invention may be prepared according to methods known in the art, such as those described in *Research Disclosure I* and James, *The Theory of the Photographic Process.* These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure,* Item 38957, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in Research Disclosure Item 36736 published November 1994, here incorporated by reference.

The SET dopants are effective at any location within the grains. Generally better results are obtained when the SET dopant is incorporated in the exterior 50 percent of the grain, based on silver. An optimum grain region for SET incorporation is that formed by silver ranging from 50 to 85 percent of total silver forming the grains. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

SET dopants are known to be effective to reduce reciprocity failure. In particular the use of iridium hexacoordination complexes or $Ir^{+4}$ complexes as SET dopants is advantageous.

Iridium dopants that are ineffective to provide shallow electron traps (non-SET dopants) can also be incorporated into the grains of the silver halide grain emulsions to reduce reciprocity failure. To be effective for reciprocity improvement the Ir can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations.

The contrast of the photographic element can be further increased by doping the grains with a hexacoordination complex containing a nitrosyl or thionitrosyl ligand (NZ dopants) as disclosed in McDugle et al U.S. Pat. No. 4,933,272, the disclosure of which is here incorporated by reference.

The contrast increasing dopants can be incorporated in the grain structure at any convenient location. However, if the NZ dopant is present at the surface of the grain, it can reduce the sensitivity of the grains. It is therefore preferred that the NZ dopants be located in the grain so that they are separated from the grain surface by at least 1 percent (most preferably at least 3 percent) of the total silver precipitated in forming the silver iodochloride grains. Preferred contrast enhancing concentrations of the NZ dopants range from $1\times10^{-11}$ to $4\times10^{-8}$ mole per silver mole, with specifically preferred concentrations being in the range from $10\times10^{-10}$ to $10^{-8}$ mole per silver mole.

Although generally preferred concentration ranges for the various SET, non-SET Ir and NZ dopants have been set out above, it is recognized that specific optimum concentration ranges within these general ranges can be identified for specific applications by routine testing. It is specifically contemplated to employ the SET, non-SET Ir and NZ dopants singly or in combination. For example, grains containing a combination of an SET dopant and a non-SET Ir dopant are specifically contemplated. Similarly SET and NZ dopants can be employed in combination. Also NZ and Ir dopants that are not SET dopants can be employed in combination. Finally, the combination of a non-SET Ir dopant with a SET dopant and an NZ dopant. For this latter three-way combination of dopants it is generally most convenient in terms of precipitation to incorporate the NZ dopant first, followed by the SET dopant, with the non-SET Ir dopant incorporated last.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I.* The vehicle can be present in the emulsion in any amount useful in photographic emulsions. The emulsion can also include any of the addenda known to be useful in photographic emulsions.

The silver halide to be used in the invention may be advantageously subjected to chemical sensitization. Compounds and techniques useful for chemical sensitization of silver halide are known in the art and described in *Research Disclosure I* and the references cited therein. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C., as described in *Research Disclosure I*, Section IV (pages 510–511) and the references cited therein.

The silver halide may be sensitized by sensitizing dyes by any method known in the art, such as described in *Research Disclosure I.* The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I,* section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I,* or in T. H. James, editor, *The Theory of the Photographic Process,* 4th Edition, Macmillan, N.Y., 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethylaniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Dye images can be formed or amplified by processes which employ in combination with a dye-image-gencrating reducing agent an inert transition metalion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, *Research Disclosure,* Vol. 116, December, 1973, Item 11660, and Bissonette *Research Disclosure,* Vol. 148, August, 1976, Items 14836, 14846 and 14847. The photographic elements can be particularly adapted to form dye images by such processes as illustrated by Dunn et al U.S. Pat. No. 3,822,129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

Development is followed by bleach-fixing, to remove silver or silver halide, washing and drying.

The following examples illustrate the use of the dye combinations of the invention.

EXAMPLE 1

This example demonstrates the use of dye combinations of this invention with a cubic AgCl emulsion.

In this experiment, a pure AgCl emulsion of predominantly cubic morphology was used. The median grain size was 0.39 micron cubic edge length (CEL). The emulsion was chemically sensitized (finished) by melting the to emulsion at 40 degrees C., then adding colloidal aurous sulfide at 0.0177 g per mole of AgCl, and heating the emulsion to 65 degrees C. for 55 minutes prior to chilling the emulsion.

The sensitizing dyes were added by re-melting the emulsion at 40 degrees C., and adding the dyes from methanolic solutions at a concentration of 0.000471 moles per liter to produce a dye-to-silver ratio of $3.8\times10^{-4}$ moles of dye per silver mole. The emulsion was held with stirring for 20 minutes, then chilled with stirring.

The two dyes comprising a particular combination were tested by adding each of them individually to the emulsion, and also by adding them to the emulsion simultaneously from pre-mixed co-solutions in the percentages 75% Dye 1, 25% Dye 2; 50% Dye 1, 50% Dye 2; 25% Dye 1, 75% Dye 2.

The dyed emulsions were coated onto an ESTAR™ support using a coating machine equipped with an extrusion device to deliver the melted emulsion onto the support.

The melt as coated consisted of emulsion, gelatin, water, dye solutions as described above, the surfactant saponin (which is a naturally occurring glycoside), and the hardener 1,1'-(oxybis-(methylenesulfonyl)bis-)ethene (BVSME).

The total "wet" laydown was 157.2 g/m$^2$ (14.6 mg/ft$^2$). After chilling and drying, the resulting single-layer coatings contained 3229 mg/m$^2$ of silver, 7319 mg/m$^2$ of gelatin, 122.6 mg/m$^2$ of BVSME, and 144.8 mg/m$^2$ of saponin.

A spectrum was obtained of the coated material using a scanning spectrophotometer equipped with an integrating sphere. The coated materials were exposed with a sensitometer equipped with a tungsten light source which is filtered with a collection of Wratten filters designed to approximate exposure through a color film negative. A step tablet was used to provide a D logE curve from which photographic speed at 0.8 density units above Dmin was determined, as is familiar to those skilled in the art.

The exposed strips were developed in the following process at 20 degrees C.

1. KODAK DK-50™ developer for 6 minutes, 0 seconds.
2. KODAK INDICATOR STOP™ stop bath for 15 seconds.
3. KODAK F5™ fix for 5 minutes 0 seconds.
4. Distilled water wash for 10 minutes 0 seconds.

The data from this experiment for a variety of inventive and comparative dye pairs is shown in Table I.

TABLE I

Data Obtained for Paris of Dyes on AgCl Cubic Emulsion. I = inventive. C = comparative.

| Type | Long Dye | Short Dye | ΔE (eV) | Ratio (% long dye | Aggregate Wave-length (nm) | Aggregate Peak Height (% A)* | Speed** |
|---|---|---|---|---|---|---|---|
| C | F1 | D1 | 0.15 | 100 | 465 | 60.5 | 144 |
| | | | | 75 | 462 | 56.1 | 139 |
| | | | | 50 | 459 | 53.0 | 135 |
| | | | | 25 | 440 | 48.3 | 124 |
| | | | | 0 | 440 | 58.0 | 101 |
| C | D1 | C1 | — | 100 | 439.2 | 55.2 | n.a.*** |
| | | | | 75 | 438.7 | 51.4 | n.a. |
| | | | | 50 | 438.5 | 43.0 | n.a. |
| | | | | 25 | 437.7 | 29.5 | n.a. |
| | | | | 0 | no peak; | does not | aggregate |
| C | C1 | B1 | — | 100 | no peak; | does not | aggregate |
| | | | | 75 | no peak; | does not | aggregate |
| | | | | 50 | 424.1 | 36.4 | n.a. |
| | | | | 25 | 423.1 | 45.3 | n.a. |
| | | | | 0 | 421.0 | 49.0 | n.a. |
| I | B1 | A1 | 0.09 | 100 | 421.0 | 49.0 | n.a. |
| | | | | 75 | 418.0 | 47.9 | n.a. |
| | | | | 50 | 412.0 | 48.1 | n.a. |
| | | | | 25 | 409.3 | 51.4 | n.a. |
| | | | | 0 | 408.3 | 53.8 | n.a. |
| I | F2 | E1 | 0.11 | 100 | 470 | 60.9 | 145 |
| | | | | 75 | 467 | 58.0 | 143 |
| | | | | 50 | 462 | 55.8 | 138 |
| | | | | 25 | 455 | 56.4 | 131 |
| | | | | 0 | 451 | 59.5 | 116 |
| I | F2 | E2 | 0.08 | 100 | 470.4 | 56.3 | 150 |
| | | | | 75 | 467.8 | 55.1 | 147 |
| | | | | 50 | 464.7 | 51.1 | 133 |
| | | | | 25 | 460.9 | 55.9 | 136 |
| | | | | 0 | 456.9 | 56.4 | 122 |
| I | F2 | E6 | 0.07 | 100 | 470.4 | 56.3 | 150 |
| | | | | 75 | 467.9 | 56.0 | 139 |
| | | | | 50 | 464.9 | 54.9 | 129 |
| | | | | 25 | 461.2 | 52.8 | 113 |
| | | | | 0 | 457.9 | 54.4 | 97 |

TABLE I-continued

Data Obtained for Paris of Dyes on AgCl Cubic Emulsion. I = inventive. C = comparative.

| Type | Long Dye | Short Dye | ΔE (eV) | Ratio (% long dye | Aggregate Wave-length (nm) | Aggregate Peak Height (% A)* | Speed** |
|---|---|---|---|---|---|---|---|
| I | F2 | E3 | 0.09 | 100 | 470.0 | 52.3 | 137 |
| | | | | 75 | 465.5 | 52.3 | 136 |
| | | | | 50 | 461.1 | 52.5 | 132 |
| | | | | 25 | 457.1 | 55.4 | 126 |
| | | | | 0 | 454.3 | 59.7 | 118 |
| I | F1 | E1 | 0.08 | 100 | 464.7 | 60.3 | 136 |
| | | | | 75 | 462.4 | 59.5 | 133 |
| | | | | 50 | 459.2 | 56.8 | 128 |
| | | | | 25 | 454.8 | 56.4 | 121 |
| | | | | 0 | 451.2 | 60.3 | 109 |
| I | F1 | E4 | 0.09 | 100 | 465.1 | 55.2 | 143 |
| | | | | 75 | 463.7 | 53.3 | 139 |
| | | | | 50 | 461.6 | 48.3 | 129 |
| | | | | 25 | 457.7 | 41.6 | 118 |
| | | | | 0 | 450.2 | 32.7 | 88 |
| I | F3 | E1 | 0.09 | 100 | 465.8 | 50.1 | 106 |
| | | | | 75 | 460.5 | 54.3 | 116 |
| | | | | 50 | 457.2 | 57.5 | 117 |
| | | | | 25 | 454.1 | 58.7 | 114 |
| | | | | 0 | 450.9 | 58.6 | 108 |
| I | F4 | E1 | 0.08 | 100 | 464.1 | 54.2 | 138 |
| | | | | 75 | 461.9 | 54.5 | 136 |
| | | | | 50 | 458.0 | 53.6 | 130 |
| | | | | 25 | 453.4 | 54.4 | 123 |
| | | | | 0 | 450.9 | 58.6 | 108 |

*% A is defined as 100-(% T + k), where % T is Beers's Law percent Transmittance, as is well-known n the art, and k represents the light losses due to scattering and reflectance. The scale is from 0 to 100, where higher numbers indicate more light absorption This emulsion is predominantly AgCl, so that the structural requirement for the practice of the invention is much more stringent than when the substrate is predominantly AgBr. In particular, (a) where dyes may bear two 5 position substituents, at least one of them must be aromatic, and (b) the symmetrical dinapthoxazole chromophore is excluded from the invention because it does not aggregate on the AgCl emulsion.

It is readily apparent that the above data indicates that the inventive pairs of dyes maintain the height of the combined aggregate peak, that they result in a steady progression of peak wavelength between the long and the short dye, and that they preserve photographic speed, and that all three of these features are accomplished to a much greater extent than for the comparative pairs of dyes.

EXAMPLE 2

In this example a predominantly AgBr three-dimensional emulsion of cubic morphology was used.

The nominal halide composition was $AgBr_{97.4\%}\ I_{2.6\%}$. The median grain size was 0.20 μm equivalent spherical diameter (esd). The emulsion was chemically sensitized by melting the emulsion and applying the chemical sensitizers NaSCN at a level of 44 mg per mole of silver, $Na_2S_2O_3$.5H2O at a level of 33 mg per mole of silver, and $KAuCl_4$ at a level of 6.6 mg per silver mole.

The sensitizing dyes were added by re-melting the emulsion at 40 degrees C., and adding the dyes from methanolic solutions at a concentration of 0.00035 moles per liter to produce a dye-to-silver ratio of $8\times10^{-4}$ moles of dye per silver mole. The emulsion was held with stirring for 20 minutes, then chilled with stirring.

The two dyes comprising a particular combination were tested by adding each of them individually to the emulsion, and also by adding them to the emulsion simultaneously from pre-mixed co-solutions in the percentages 75% Dye 1, 25% Dye 2; 50% Dye 1, 50% Dye 2; 25% Dye 1, 75% Dye 2.

The cubic emulsion melts were coated on a machine equipped with an extrusion device to deliver the melted emulsion as a single layer to ESTAR™ support. The melts were coated at 10.8 mg/dm$^2$ silver and 77 mg/dm$^2$ gelatin, and hardened with 0.08% bis(vinylsulfonyl)methylether (BVSME).

A spectrum was obtained of the coated material using a scanning spectrophotometer equipped with an integrating sphere. The coated materials were exposed with a single-grating transmission sensitometer which produces a separate D log E curve at 10 nm intervals across the visible spectrum. The result is a "wedge spectograph", which is well-known in the art. (See example, "Use os Special Sensitizing Dyes To Estimate Effective Levels of Silver Halide Substrates", by P. B. Gilman, Jr., in Photographic Science and Engineering, Volume 18, Number 5, September/October 1974.) The exposed coatings were processed at 35 degrees C. in an Eastman KODAK RP X-OMAT™ machine.

The data from this experiment for a variety of inventive and comparative dye pairs is shown in Table II.

TABLE II

Data Obtained for Paris of Dyes on AgBr Cubic Emulsion. I = inventive. C = comparative.

| Type | Long Dye | Short Dye | ΔE (eV) | Ratio (% long dye | Aggregate Wave-length (nm) | Aggregate Peak Height (% A)* | Speed** |
|---|---|---|---|---|---|---|---|
| I | F1 | E1 | 0.08 | 100 | 464.3 | 57.1 | 248 |
| | | | | 75 | 461.6 | 55.2 | 245 |
| | | | | 50 | 457.7 | 53.4 | 241 |
| | | | | 25 | 453.7 | 54.9 | 245 |
| | | | | 0 | 451.1 | 56.8 | 247 |
| I | F3 | E1 | 0.09 | 100 | 465.6 | 57.3 | 247 |
| | | | | 75 | 461.6 | 54.8 | 237 |
| | | | | 50 | 457.4 | 55.4 | 240 |
| | | | | 25 | 454.1 | 56.1 | |
| | | | | 0 | 451.1 | 56.8 | 244 |
| I | D1 | C1 | 0.05 | 100 | 441.0 | 62.0 | 224 |
| | | | | 75 | 439.7 | 59.7 | 222 |
| | | | | 50 | 436.9 | 57.9 | 221 |
| | | | | 25 | 435.1 | 59.4 | 222 |
| | | | | 0 | 433.6 | 54.2 | 218 |
| I | C1 | B1 | 0.06 | 100 | 433.7 | 54.0 | 218 |
| | | | | 75 | 432.9 | 59.4 | 220 |
| | | | | 50 | 430.2 | 60.1 | 222 |
| | | | | 25 | 427.5 | 62.9 | 225 |
| | | | | 0 | 425.0 | 65.6 | 229 |
| I | B1 | A1 | 0.08 | 100 | 425.1 | 65.9 | 229 |
| | | | | 75 | 423.6 | 64.5 | 227 |
| | | | | 50 | 419.1 | 63.1 | 222 |
| | | | | 25 | 414.1 | 65.7 | 226 |
| | | | | 0 | 413.4 | 68.8 | 239 |
| C | F1 | C1 | *0.21 | 100 | 467.4 | 59.2 | 250 |
| | | | | 75 | 465.0 | 54.1 | 240 |
| | | | | 50 | 462 & 433 | 45 & 48 | 227 & 215 |
| | | | | 25 | 460 & 434 | 35 & 53.6 | 208 & 217 |
| | | | | 0 | 433.6 | 54.2 | 218 |

TABLE II-continued

Data Obtained for Paris of Dyes on AgBr Cubic Emulsion. I = inventive. C = comparative.

| Type | Long Dye | Short Dye | ΔE (eV) | Ratio (% long dye | Aggregate Wave-length (nm) | Aggregate Peak Height (% A)* | Speed** |
|---|---|---|---|---|---|---|---|
| C | F1 | A1 | 0.35 | 100 | 467A | 59.3 | 250 |
| | | | | 75 | 464.6 | 52.5 | 244 |
| | | | | 50 | 460.8 | 44.7 | 233 |
| | | | | 25 | 455 & 411 | 34 & 62 | 220 & 226 |
| | | | | 0 | 413.5 | 68.9 | 238 |

*% A is defined as 100-(% T + k), where % T is Beers's Law percent Transmittance, as is well-known n the art, and k represents the light losses due to scattering and reflectance. The scale is from 0 to 100, where higher numbers indicate more light absorption.
n.a. = not available It is readily apparent that the above data indicates that the inventive pairs of dyes maintain the height of the combined aggregate peak, that they result in a steady progression of peak wavelength between the long and the short dye, and that they preserve photographic speed, and that all three of these features are accomplished to a much greater extent than for the comparative pairs of dyes.

EXAMPLE 3

In this example a predominantly AgBr three-dimensional emulsion of ocatahedral morphology was used.

The nominal halide composition was $AgBr_{97.0\%}\ I_{3.0\%}$. The median grain size was 0.30 μm equivalent spherical diameter (esd). The emulsion was chemically sensitized by melting the emulsion and applying the chemical sensitizers NaSCN at a level of 150 mg per mole of silver, $Na_2S_2O_3.5H_2O$ at a level of 8 mg per mole of silver, and $KAuCl_4$ at a level of 5 mg per silver mole.

The cubic emulsion melts were coated on a machine equipped with an extrusion device to deliver the melted emulsion as a single layer to ESTAR™ support. The melts were coated at 21.5 mg/dm$^2$ silver and 86 mg/dm$^2$ gelatin, and hardened with 0.08% bis(vinylsulfonyl)methylether (BVSME).

The sensitizing dyes were added by re-melting the emulsion at 40 degrees C., and adding the dyes from methanolic solutions at a concentration of 0.00032 moles per liter to produce a dye-to-silver ratio of $4.0\times10^{-4}$ moles of dye per silver mole. The emulsion was held with stirring for 20 minutes, then chilled with stirring.

The two dyes comprising a particular combination were tested by adding each of them individually to the emulsion, and also by adding them to the emulsion simultaneously from pre-mixed co-solutions in the percentages 75% Dye 1, 25% Dye 2; 50% Dye 1, 50% Dye 2; 25% Dye 1, 75% Dye 2.

A spectrum was obtained of the coated material using a scanning spectrophotometer equipped with an integrating sphere. The coated materials were exposed with a single-grating transmission sensitometer which produces a separate D log E curve at 10 nm intervals across the visible spectrum. The result is a "wedge spectrograph", which is well-known in the art. (See, for example, "Use of Spectral Sensitizing Dyes To Estimate Effective Energy Levels of Silver Halide Substrates", by P. B. Gilman, Jr., in Photographic Science and Engineering, Volume 18, Number 5, September/October 1974.) The exposed coatings were processed at 35 degrees C. in an Eastman KODAK RP X-OMAT™ machine.

The data from this experiment for a variety of inventive and comparative dye pairs is shown in Table III.

TABLE III

Data Obtained for Paris of Dyes on AgBr Octahedral Emulsion. I = inventive. C = comparative.

| Type | Long Dye | Short Dye | ΔE (eV) | Ratio (% long dye | Aggregate Wave-length (nm) | Aggregate Peak Height (% A)* | Speed** |
|---|---|---|---|---|---|---|---|
| I | F1 | E1 | 0.06 | 100 | 460.6 | 61.6 | 257 |
| | | | | 75 | 458.2 | 60.6 | 253 |
| | | | | 50 | 455.2 | 60.1 | 252 |
| | | | | 25 | 452.3 | 60.9 | 253 |
| | | | | 0 | 450.1 | 62.7 | 255 |
| I | F3 | E1 | 0.10 | 100 | 466.6 | 60.9 | 255 |
| | | | | 75 | 458.5 | 60.2 | 253 |
| | | | | 50 | 454.6 | 61.7 | 254 |
| | | | | 25 | 452.1 | 62.0 | 255 |
| | | | | 0 | 450.1 | 62.7 | 255 |
| I | F1 | E5 | 0.05 | 100 | 460.8 | 61.0 | 257 |
| | | | | 75 | 458.9 | 59.7 | 255 |
| | | | | 50 | 456.4 | 58.6 | 253 |
| | | | | 25 | 454.0 | 59.9 | 256 |
| | | | | 0 | 452.8 | 58.2 | 262 |
| C | F1 | D2 | 0.15 | 100 | 460.8 | 61.0 | 257 |
| | | | | 75 | 457.6 | 58.2 | 255 |
| | | | | 50 | 451 & 435 | 56 & 60 | 250 |
| | | | | 25 | 435.2 | 60.2 | 244 |
| | | | | 0 | 436.0 | 64.3 | 245 |

*% A is defined as 100-(% T + k), where % T is Beers's Law percent Transmittance, as is well-known n the art, and k represents the light losses due to scattering and reflectance. The scale is from 0 to 100, where higher numbers indicate more light absorption.

It is readily apparent that the above data indicates that the inventive pairs of dyes maintain the height of the combined aggregate peak, that they result in a steady progression of the peak wavelength between the long and the short dye, and that they preserve photographic speed, and that all three of these features are accomplished to a much greater extent than for the comparative pairs of dyes.

EXAMPLE 4

In this example the emulsion used was a predominantly silver chloride, ruthenium doped, (1.0.0) tabular grain emulsion. The average grain diameter was 0.60 microns equivalent circular diameter (ecd). The average grain thickness was 0.17 microns. The precise halide ratio was 99.404% chloride and 0.596% iodide. The emulsion was doped with 125 ppm ruthenium hexacyanide.

The emulsion was heated to 39° C. and 50 mg/Ag mole of potassium bromide, 1.7 mg/Ag mole of potassium tetrachloroaurate, sensitizing dyes F2 and E1 (ΔE=0.09 eV) in ratios shown in Table IV, and 3.4 mg/Ag mole of sodium thiosulfate was added. The emulsion was heated to 60° C., held for 25 min. and then cooled to 39° C. Then 100 mg/Ag mole of 1-(3-acetamidophenyl)-5-mercaptotetrazole was added. The emulsion was then coated on triacetate film with the yellow coupler of formula Y-C. The film was then dried.

Y-C

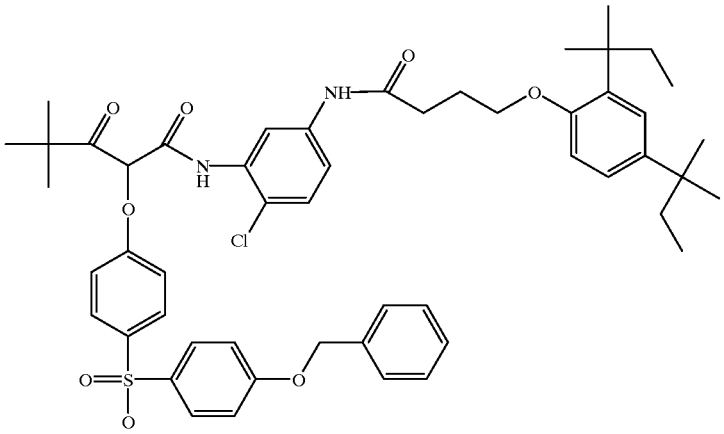

The film was exposed to white light at 3000K for a time of 0.004 sec. It was then processed in the ECP-2™ process for 3 min. at 98° F. The spectral absorption of the coated film samples was measured on a spectrophotometer. Results were obtained for the different ratiosof sensitizing dyes. These results are given in Table IV.

TABLE IV

| Sample Number | F2 quantity (%) | E1 quantity (%) | Minimum density | Wave-Speed** | Aggregate Peak length (nm) | Aggregate Height (% A)* |
|---|---|---|---|---|---|---|
| 5-1 | 100 | 0 | 0.15 | 168 | 471 | 30.8 |
| 5-2 | 83.5 | 16.5 | 0.12 | 190 | 469 | 29.0 |
| 5-3 | 67.0 | 33.0 | 0.11 | 172 | 468 | 26.1 |
| 5-4 | 58.7 | 41.3 | 0.10 | 167 | 466 | 25.8 |
| 5-5 | 50.3 | 49.7 | 0.08 | 164 | 462 | 24.8 |
| 5-6 | 42.0 | 58.0 | 0.10 | 166 | 461 | 22.3 |
| 5-7 | 33.7 | 66.3 | 0.10 | 169 | 459 | 25.1 |
| 5-8 | 16.8 | 83.2 | 0.09 | 160 | 458 | 27.3 |
| 5-9 | 0 | 100 | 0.08 | 156 | 456 | 30.6 |

*% A is defined as 100-(% T + k), where % T is Beers's Law percent Transmittance, as is well-known n the art, and k represents the light losses due to scattering and reflectance. The scale is from 0 to 100, where higher numbers indicate more light absorption.

The dye quantities given are the percent ratios of the millimoles of dye per silver mole. As can be seen, the dye peak transitions smoothly from 471 nm to 456 nm as the ratio of dye changes.

EXAMPLE 5

Dye combinations (Table V) were made from two dyes (Table B) which were blended in the following ratios 75/25, 50/50 and 25/75. Dyes and dye combination at a level of $3.8\times10^{-4}$ moles/Ag mole, were added to an aurous sulfide sensitized 0.39 $\mu$m(cubic edge length) silver chloride cubic emulsions which had 1.0% bromide present. The emulsions were coated on a polyester support in a Black and White format. The coatings were given a 1/10 second exposure on a wedge spectrographic instrument covering a wavelength range from 350 to 750 nm. The instrument contains a tungsten light source and a step tablet ranging in density from 0 to 3 density steps. Correction for the instrument's variation in spectral irradiance with wavelength is done via computer. Results are reported in Table V. Delta is the speed of a coating at a Dye 1/Dye 2 ratio of 25/75 minus the speed at a Dye 1/Dye 2 ratio of 75/25 . The λmax at each dye ratio was determined from spectrophotometric measurements of the coatings.

Processing

Temperature 68° F.(20° C.)

| Chemical | Process time |
|---|---|
| DK-50 developer | 6 minutes 0 seconds |
| Stop bath* | 15 seconds |
| Fix** | 5 minutes 0 seconds |
| Wash | 10 minutes 0 seconds |

*composition is 128 mL acetic acid diluted to 8 L with distilled water.
**composition is 15.0 g sodium sulfite, 240.0 g sodium thiosulfate, 13.3 mL glacial acetic acid, 7.5 g boric acid, and 15.0 g potassium aluminum sulfate diluted to 1.0 L with distilled water.

TABLE V

Data comparing change in photographic speed
I = inventive. C = comparative.

| Sample No. | Dye 1 | Dye 2 | ΔE (eV) | λ max (nm) of Dye blends 100/0 | 75/25 | 50/50 | 25/75 | 0/100 | Delta* |
|---|---|---|---|---|---|---|---|---|---|
| 5-I-1 | F2 | E1 | 0.11 | 470 | 467 | 462 | 455 | 451 | −5 |
| 5-I-2 | F1 | E1 | 0.08 | 465 | 462 | 459 | 455 | 451 | −8 |
| 5-I-3 | F4 | E1 | 0.08 | 464 | 462 | 458 | 453 | 451 | −6 |
| 5-I-4 | F2 | F8 | 0.03 | 470 | 469 | 466 | 464 | 464 | −4 |
| 5-I-5 | F2 | F9 | 0.05 | 470 | 469 | 467 | 465 | 462 | 2 |
| 5-I-6 | F2 | F6 | 0.06 | 470 | 467 | 464 | 462 | 459 | −1 |
| 5-I-7 | F2 | F10 | 0.08 | 470 | 467 | 464 | 460 | 456 | −3 |
| 5-I-8 | F2 | E2 | 0.08 | 470 | 468 | 465 | 461 | 457 | −4 |
| 5-I-9 | F2 | E6 | 0.07 | 470 | 468 | 465 | 461 | 458 | −10 |
| 5-I-10 | F2 | E'1 | 0.10 | 470 | 467 | 463 | 456 | 453 | −7 |
| 5-I-11 | F2 | E2 | 0.12 | 470 | 467 | 462 | 454 | 450 | −8 |
| 5-I-12 | F1 | E3 | 0.08 | 465 | 464 | 461 | 456 | 452 | −11 |
| 5-I-13 | F1 | E4 | 0.09 | 465 | 464 | 462 | 458 | 450 | −18 |
| 5-I-14 | F3 | E1 | 0.09 | 466 | 461 | 457 | 454 | 451 | −1 |
| 5-I-16 | F2 | F7 | 0.06 | 470 | 468 | 466 | 464 | 460 | 0 |
| 5-C-1 | F1 | D1 | 0.16 | 465 | 462 | 450 | 440 | 439 | −30 |

*Delta is the speed of a coating at a Dye 1/Dye 2 ratio of 25/75 minus the speed at a Dye 1/Dye 2 ratio of 75/25.

As can be seen from Table V, the invention dye combinations allow the sensitization maximum to be adjusted by varying the ratio of the two dyes. The invention dye combinations give less speed loss than the comparison dye combination.

The invention has been described in detail with particular reference to preferred embodiments, but it will be understood that variations and modifications can be effected within the spirit and scope of the invention.

What is claimed is:

1. A photographic element comprising at least one silver halide emulsion layer in which the silver halide has been sensitized with a first J-aggregating blue sensitizing dye having a $\lambda_1$ less than or equal to about 475 nm and a second J-aggregating blue sensitizing dye having a $\lambda_2$, wherein said first and second dyes form a mixed aggregate and wherein $\lambda_1$ is longer than $\lambda_2$ and $\lambda_1$ and $\lambda_2$ are separated by an energy gap, ΔE, which does not exceed 0.12 eV, where ΔE is defined by the following relationship:

$$\Delta E = 1.25(\text{nm})(\text{eV}) \times 10^3 \left[ \frac{1}{\lambda_2(\text{nm})} - \frac{1}{\lambda_1(\text{nm})} \right] \leq 0.12\ (\text{eV})$$

wherein $\lambda_1$ is the wavelength in nanometers (nm) of maximum absorption of a silver halide emulsion sensitized with the first dye and $\lambda_2$ is the wavelength of maximum absorption of a silver halide emulsion sensitized with the second dye, with the proviso that neither the first nor the second dye contains selenium and that each dye contains an anionic water solubilizing group.

2. A photographic element according to claim 1, wherein said first and second dyes are selected from the group consisting of:

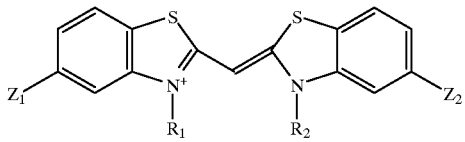

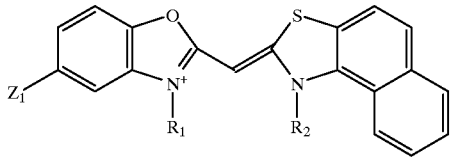

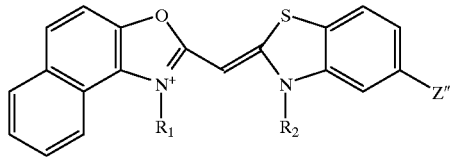

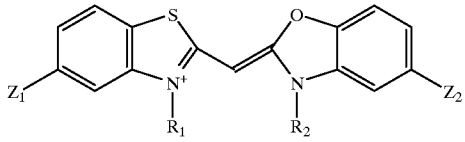

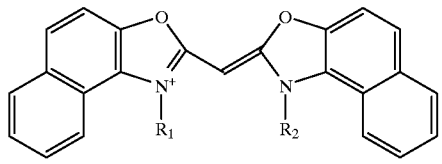

-continued

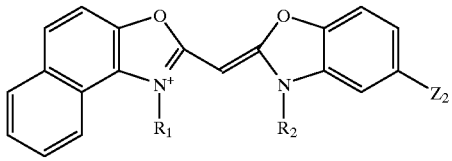

and

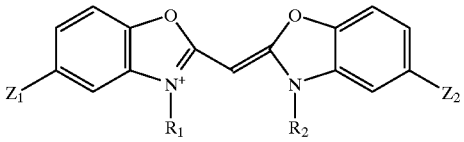

wherein $Z_1$, $Z_2$ and Z" are independently a hydrogen or halogen atom or a substituted or unsubstituted alkyl, substituted or unsubstituted alkoxy, substituted or unsubstituted aromatic, substituted or unsubstituted alkoxycarbonyl and substituted or unsubstituted heterocyclic group; and $R_1$ and $R_2$, are independently substituted or unsubstituted alkyl, substituted or unsubstituted alkenyl or substituted or unsubstituted aryl, with the proviso that for each dye at least one of $R_1$ and $R_2$ contains an anionic water solubilizing group.

3. A photographic element according to claim 2, wherein the first dye has a maximum peak wavelength of about 470 nm and the second dye has a maximum peak wavelength of about 450 nm or greater.

4. A photographic element according to claim 2, wherein the first dye has a maximum peak wavelength of about 450 nm and the second dye has a maximum peak wavelength of about 440 nm or greater.

5. A photographic element according to claim 2, wherein the first dye has a maximum peak wavelength of about 420 nm and the second dye has a maximum peak wavelength of about 410 nm or greater.

6. A photographic element according to claim 2, wherein the first dye is of the structure:

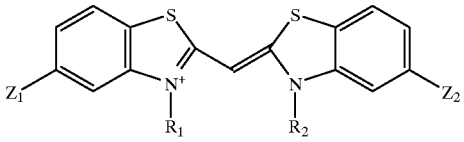

and the second dye is of the structure:

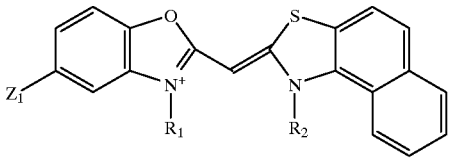

wherein $Z_1$ and $Z_2$ are independently a hydrogen or halogen atom or a substituted or unsubstituted alkyl, substituted or unsubstituted alkoxy, substituted or unsubstituted aromatic, substituted or unsubstituted alkoxycarbonyl and substituted or unsubstituted heterocyclic group; and $R_1$ and $R_2$, are independently substituted or unsubstituted alkyl, substituted or unsubstituted alkenyl or substituted or unsubstituted aryl.

7. A photographic element according to claim 2, wherein the first dye is of the structure:

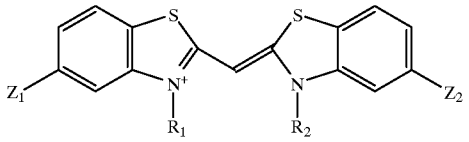

and the second dye is of the structure:

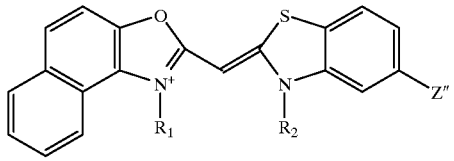

wherein $Z_1$, $Z_2$ and Z" are independently a hydrogen or halogen atom or a substituted or unsubstituted alkyl, substituted or unsubstituted alkoxy, substituted or unsubstituted aromatic, substituted or unsubstituted alkoxycarbonyl and substituted or unsubstituted heterocyclic group; and $R_1$ and $R_2$, are independently substituted or unsubstituted alkyl, substituted or unsubstituted alkenyl or substituted or unsubstituted aryl.

8. A photographic element according to claim 2, wherein the first dye is of the structure:

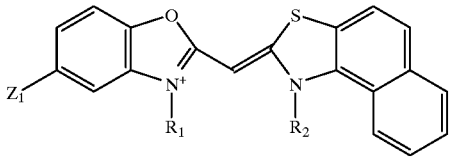

and the second dye is of the structure:

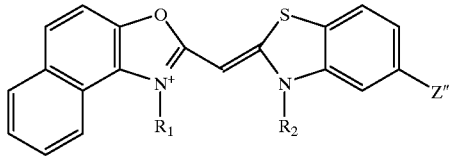

wherein $Z_1$ and Z" are independently a hydrogen or halogen atom or a substituted or unsubstituted alkyl, substituted or unsubstituted alkoxy, substituted or unsubstituted aromatic, substituted or unsubstituted alkoxycarbonyl and substituted or unsubstituted heterocyclic group; and $R_1$ and $R_2$, are independently substituted or unsubstituted alkyl, substituted or unsubstituted alkenyl or substituted or unsubstituted aryl.

9. A photographic element according to claim 2, wherein the first dye is of the structure:

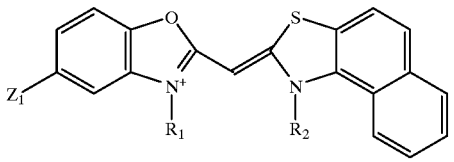

and the second dye is of the structure:

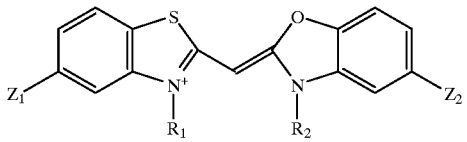

wherein $Z_1$ and $Z_2$ are independently a hydrogen or halogen atom or a substituted or unsubstituted alkyl, substituted or unsubstituted alkoxy, substituted or unsubstituted aromatic, substituted or unsubstituted alkoxycarbonyl and substituted or unsubstituted heterocyclic group; and $R_1$ and $R_2$, are independently substituted or unsubstituted alkyl, substituted or unsubstituted alkenyl or substituted or unsubstituted aryl.

10. A photographic element according to claim 2, wherein the first dye is of the structure:

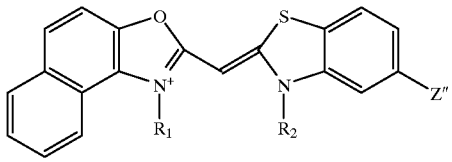

and the second dye is of the structure:

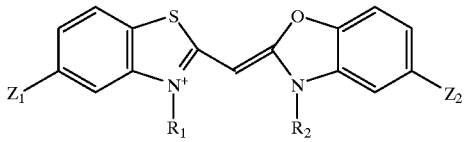

wherein $Z_1$, $Z_2$ and Z" are independently a hydrogen or halogen atom or a substituted or unsubstituted alkyl, substituted or unsubstituted alkoxy, substituted or unsubstituted aromatic, substituted or unsubstituted alkoxycarbonyl and substituted or unsubstituted heterocyclic group; and $R_1$ and $R_2$, are independently substituted or unsubstituted alkyl, substituted or unsubstituted alkenyl or substituted or unsubstituted aryl.

11. A photographic element according to claim 2, wherein the first dye is of the structure:

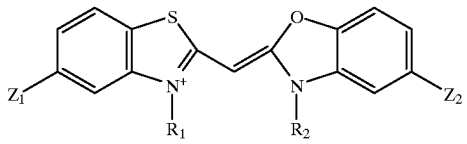

and the second dye is of the structure:

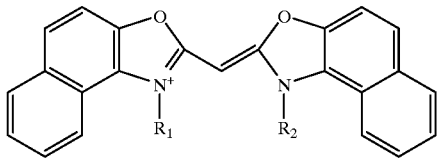

wherein $Z_1$ and $Z_2$ are independently a hydrogen or halogen atom or a substituted or unsubstituted alkyl, substituted or unsubstituted alkoxy, substituted or unsubstituted aromatic, substituted or unsubstituted alkoxycarbonyl and substituted or unsubstituted heterocyclic group; and $R_1$ and $R_2$, are independently substituted or unsubstituted alkyl, substituted or unsubstituted alkenyl or substituted or unsubstituted aryl.

12. A photographic element according to claim 2, wherein the first dye is of the structure:

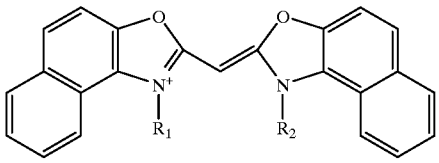

and the second dye is of the structure:

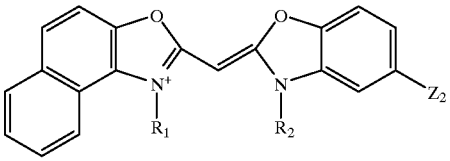

wherein $Z_2$ is a hydrogen or halogen atom or a substituted or unsubstituted alkyl, substituted or unsubstituted alkoxy, substituted or unsubstituted aromatic, substituted or unsubstituted alkoxycarbonyl and substituted or unsubstituted heterocyclic group; and $R_1$ and $R_2$, are independently substituted or unsubstituted alkyl, substituted or unsubstituted alkenyl or substituted or unsubstituted aryl.

13. A photographic element according to claim 2, wherein the first dye is of the structure:

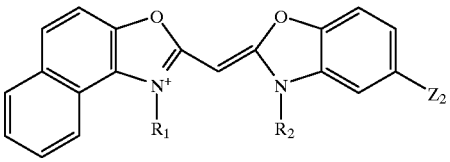

and the second dye is of the structure:

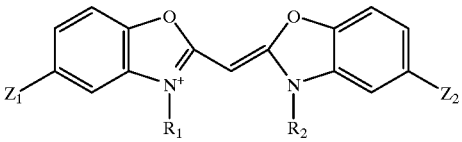

wherein $Z_1$ and $Z_2$ are independently a hydrogen or halogen atom or a substituted or unsubstituted alkyl, substituted or unsubstituted alkoxy, substituted or unsubstituted aromatic, substituted or unsubstituted alkoxycarbonyl and substituted or unsubstituted heterocyclic group; and $R_1$ and $R_2$, are independently substituted or unsubstituted alkyl, substituted or unsubstituted alkenyl or substituted or unsubstituted aryl.

14. A photographic element according to claim 1, wherein the first dye and/or the second dye is of structure I:

Dye I

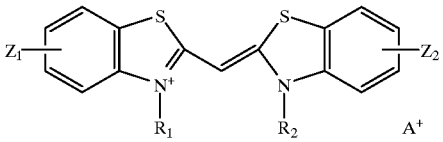

wherein:

$Z_1$ is phenyl, pyrrolyl,, furanyl, thienyl, alkoxycarbonyl or a fused benzene ring;

$Z_2$ is phenyl, pyrrolyl, furanyl, thienyl, alkoxycarbonyl or halogen, $R_1$ and $R_2$ are acid substituted alkyl groups; and $A^+$ is a counterion.

15. A photographic element according to claim 1, wherein the first dye and/or the second dye is of structure II:

Dye II

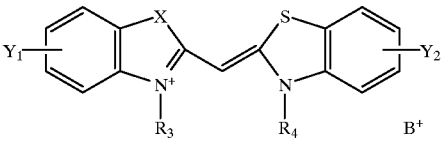

wherein

X is O or S, $Y_1$ is pyrrolyl, furanyl, thienyl, alkoxycarbonyl or phenyl;

$Y_2$ is a 4,5-benzo substituent when X is O and a phenylcarbamoyl or a phenylcarboxamido substituent when X is S;

$R_3$ and $R_4$ are acid substituted alkyl groups; and $B^+$ is a counterion.

* * * * *